US005581283A

United States Patent [19]

Rogers

[11] Patent Number: 5,581,283

[45] Date of Patent: Dec. 3, 1996

[54] INK JET APPARATUS HAVING A PLURALITY OF CHAMBERS WITH MULTIPLE ORIFICES

[75] Inventor: Robert L. Rogers, Sandy Hook, Conn.

[73] Assignee: Dataproducts Corporation, Simi Valley, Calif.

[21] Appl. No.: 313,731

[22] Filed: Sep. 27, 1994

[51] Int. Cl.[6] ..... B41J 2/145; B41J 2/01

[52] U.S. Cl. ..... 347/40; 347/107

[58] Field of Search ..... 347/40, 47, 68, 347/107, 67

[56] References Cited

U.S. PATENT DOCUMENTS

| | | | |
|---|---|---|---|
| 4,587,534 | 5/1986 | Saito et al. | 347/47 X |
| 4,646,106 | 2/1987 | Howkins | 347/68 X |
| 4,714,934 | 12/1987 | Rogers | 347/107 |
| 4,901,093 | 2/1990 | Ruggiero et al. | 347/68 |
| 4,924,241 | 5/1990 | Parks et al. | 347/107 X |
| 4,967,208 | 10/1990 | Childers | 347/47 X |
| 5,258,774 | 11/1993 | Rogers | 347/40 |

*Primary Examiner*—Benjamin R. Fuller
*Assistant Examiner*—David Yockey
*Attorney, Agent, or Firm*—Woodcock Washburn Kurtz Mackiewicz & Norris

[57] ABSTRACT

Ink jet chambers of an array of ink jet devices extend laterally outwardly from a linear array of elongated transducers. This configuration creates two sets of linear arrayed orifices utilizing a single linear array of transducers so as to provide large field, high density printing for use in, for example, printing bar codes.

10 Claims, 2 Drawing Sheets

INK JET APPARATUS HAVING A PLURALITY OF CHAMBERS WITH MULTIPLE ORIFICES

BACKGROUND OF THE INVENTION

This invention relates to impulse or drop-on demand ink jet printers, and more particularly, to printers employing an array of devices so as to provide high density printing.

U.S. Pat. No. 4,901,093 discloses an impulse or a drop-on demand ink jet printer which employs a plurality of ink jet devices. Each of the devices includes a chamber with a plurality of orifices with a single elongated transducer being energized and deenergized so as to project a plurality of droplets from each group of orifices associated with each chamber. Where the orifices are linearly aligned, the transducers associated with the various chambers are also linearly aligned. Where laterally displaced orifices are employed, the transducers are also laterally displaced.

U.S. Pat. No. 4,714,934 discloses a plurality of ink jet devices wherein each device includes a plurality of orifices. The elongated transducers associated with each device are linearly aligned so as to facilitate construction. However, there is a limit to the density that can be achieved in printing since the transducers which are aligned limit the density with which the transducers may be mounted.

SUMMARY OF THE INVENTION

It is an object of this invention to provide an impulse or drop-on demand ink jet printer with a high density array of ink jet devices.

It is a further object of this invention to provide such a high density array of ink jet devices while facilitating construction of the apparatus.

In accordance with these objects of the invention, an impulse ink jet apparatus comprises a linear array of elongated transducers having axes of elongation generally parallel with the axis of ejection of droplets. A plurality of chambers is provided including linearly aligned actuation locations respectively coupled to the transducers. Each of the chambers includes an ejection portion laterally displaced with respect to the actuation location. An orifice plate includes a group of orifices respectively terminating in laterally displaced ejection portions for permitting ejection of droplets therefrom.

In accordance with this invention, the orifices in each of the groups are linearly aligned and they are preferably linearly aligned in a direction substantially parallel with the linear array of transducers.

In accordance with another important aspect of the invention, adjacent groups of orifices are laterally displaced and non-adjacent groups of orifices are linearly aligned so as to form an array of two linearly aligned sets of orifices.

In accordance with another important aspect of the invention, the orifices are equally spaced in a direction extending parallel with the linear array of transducers. It is also preferable that the ejection portions of adjacent chambers overlap in a direction extending parallel with the linear array of transducers.

In accordance with another important aspect of the invention, the ejection portions of the chambers are elongated in the direction of the linear array of the transducers. Groups of orifices are linearly arrayed in a direction parallel to the axis of elongation of the ejection portions. Preferably, all of the orifices in each group are spaced from the edge or wall of the ejection portion a distance not substantially less than the spacing between orifices in the group.

DETAILED DESCRIPTION OF A PREFERRED EMBODIMENT

Figure 1:
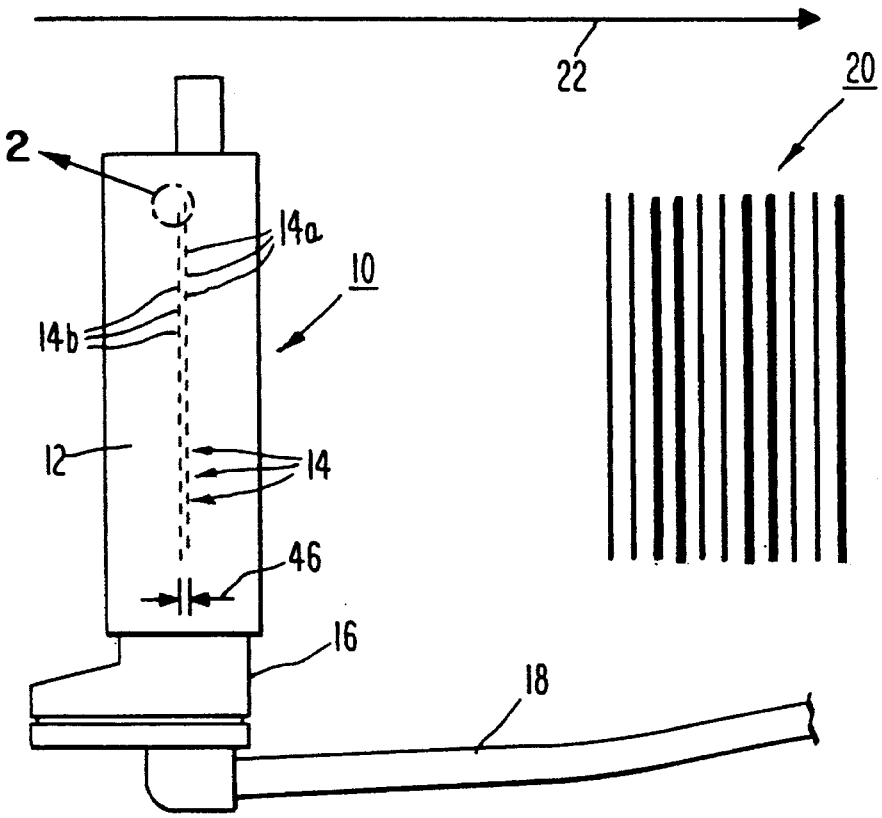
FIG. 1 is an elevational view of an ink jet printing apparatus embodying this invention alongside printed information produced by the printing apparatus.

Referring to FIG. 1, an ink jet printing apparatus of the impulse or drop-on demand type 10 is shown comprising an orifice plate 12 with groups of orifices 14 vertically arrayed along the plate 12. The first set of groups 14*a* comprising non-adjacent groups 14 on the right side of the orifice plate 12 are linearly aligned but laterally offset or displaced from transducers which will be discussed with respect to FIG. 2. A second set 14*b* of groups of orifices 14*b* at the left are also laterally offset or displaced with respect to the transducers as will be described with respect to FIG. 2.

As shown in FIG. 1, the printing apparatus which is of the drop-on demand or impulse type comprises a body 16 coupled to a hose 18 for supplying ink to the apparatus 10. In operation, droplets of ink are ejected from the orifices 14 substantially perpendicular to the orifice plate 12 on demand so as to print information such a bar code 20. This is accomplished by scanning the printing head 10 along the direction shown by the arrow 22 and energizing the transducers on demand so as to appropriately print the bar code 20. It will be appreciated that the bar code 20 may be printed with a single pass while printing continuous bars as shown as, for example, on cardboard containers or corrugated boxes. In other words, a box proceeding past a printing apparatus 10 in the direction indicated by the arrow 22 may receive the bar code 20 as shown.

Figure 2:
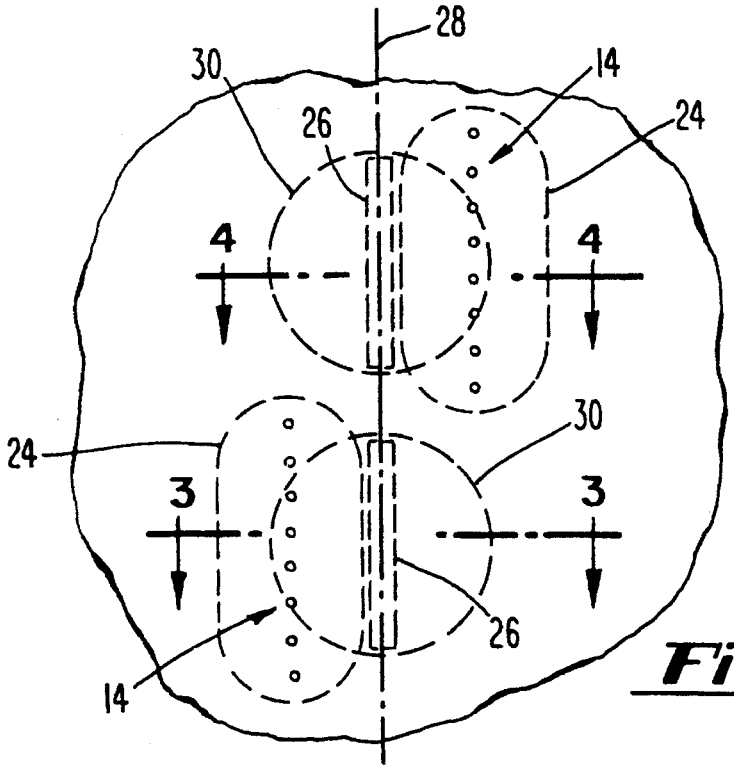
FIG. 2 is an enlarged view of the fragment 2 shown in FIG. 1.

Referring now to FIG. 2, the exact nature of the groups of orifices 14 may be discerned. Each group 14 is located at positions on the orifice plate 12 so as to terminate the ink jet device chambers at an oblong or elongated ejection portion 24 shown in dotted lines. The orifices 14 are all linearly aligned so as to be parallel with the axis of elongation of the ejection portions 24 while also being in parallel with a linear array of transducers 26 which are also shown in dotted lines. Although only two transducers 26 are shown, it will be appreciated that all transducers for the array of orifices 14 extend along a line 28 and the groups of orifices 14 are laterally displaced with respect to this line.

Figure 3:
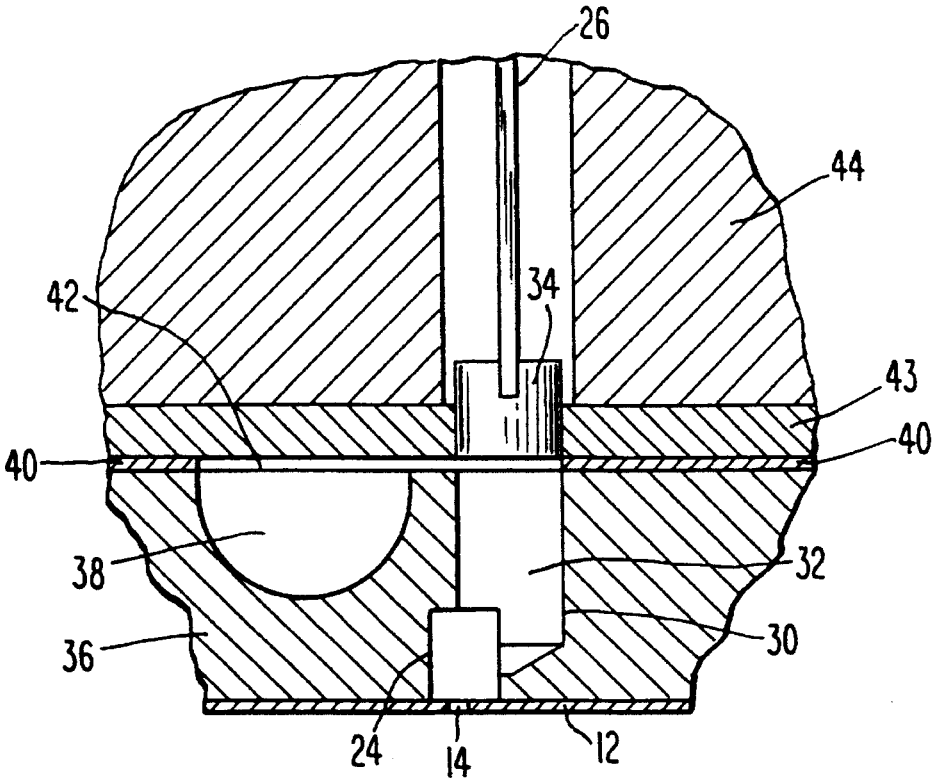
FIG. 3 is a sectional view taken along line 3—3 of FIG. 2.
Figure 4:
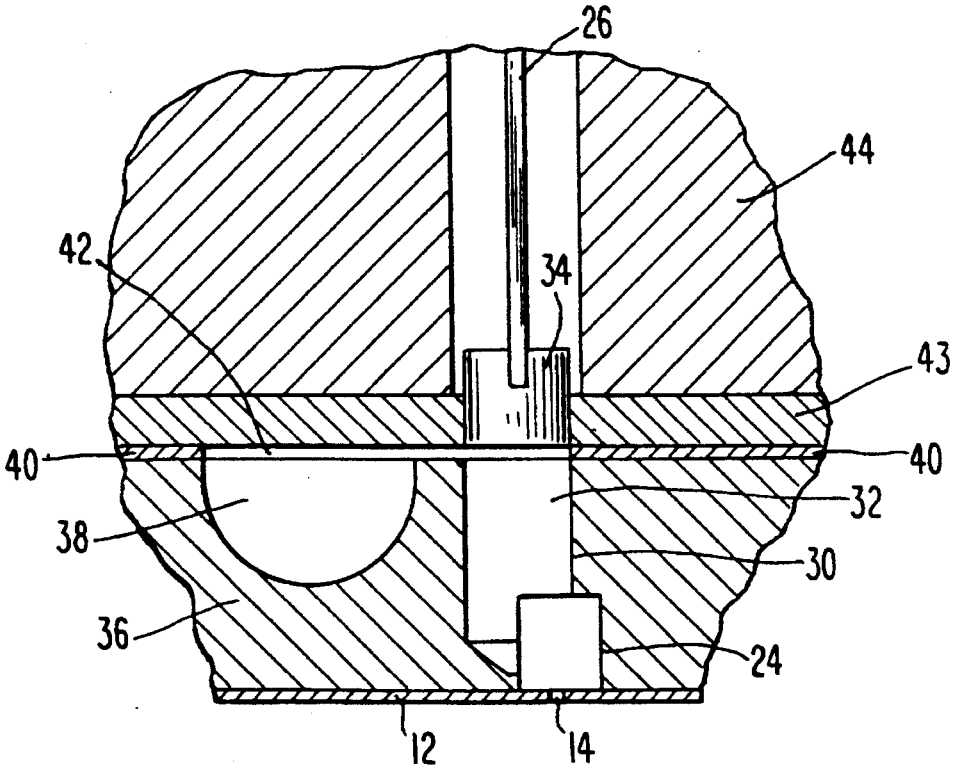
FIG. 4 is a sectional view taken along line 4—4 of FIG. 2.

This lateral displacement may be further appreciated by reference to FIGS. 3 and 4 where the ink jet printing apparatus is shown in further detail. Orifices 14 and the orifice plate 12 may be seen as terminating ejection portions 24. As may be readily seen by comparing FIGS. 3 and 4, ejection portion 24 shown in FIG. 3 is laterally offset along with a terminating orifice 14 to the left of the transducer 26 while the ejection portion 26 shown in FIG. 4 is laterally offset to the right of the transducer 26. As also shown in FIGS. 3 and 4, the ink jet devices include chambers 30 having actuation portions 32 which are aligned with transducers 26 and a foot member 34 which terminates the transducers 26 for ejecting droplets from the orifices 14 in a direction generally parallel with the transducer axis of elongation.

As also shown in FIGS. 3 and 4, the printing apparatus comprises a chamber plate 36 in which the chamber 30 is formed along with a manifold 38 which extends along the length of the printing apparatus in a direction generally parallel with the line 28. A restrictor plate 40 is provided having an opening 42 so as to permit flow of ink from the manifold 38 into the chamber 30. A foot plate 43 is located immediately above the restrictor plate 40 and below a body member 44 having openings for the transducer 26.

Referring to FIG. 2, it will be appreciated that the orifices 14 within each group are substantially equally spaced. As shown, there are eight orifices in each group although it is possible to vary the number of orifices. It will also be observed that the distance between the uppermost orifice in one group and lowermost orifice in another group in a direction along the line 28 is substantially equal to the spacing of the orifices within a particular group. This is necessary to achieve a continuous uniformly dense vertical array of jets so as to produce high quality bar codes 20 as shown in FIG. 1. However, this necessarily means that the ejection portions 24 of chambers 30 must necessarily overlap in a vertical direction or in the direction along the line 28 as shown in FIG. 2. In this regard, it is important to appreciate that the spacing between the wall of the ejection portion 24 and the nearest orifice 14 should not be substantially less than the spacing from orifice to orifice. For example, for an orifice to orifice is spacing of 0.0072 inches, the nearest spacing of the wall of the ejection portion 24 to any orifice should not be less than 0.0050 (approximately 70% of the orifice spacing) and preferably not less than 0.0060 inches (approximately 83%). If the spacing requirement is not observed, droplets ejected from orifices near the chamber wall may have different droplet velocities resulting in less than optimum printing characteristics.

Referring again to FIG. 1, it will be appreciated that a total of 256 orifices are arrayed vertically, i.e., 8 orifices per chamber. As shown, this will result in a bar code of 1.87 inches in height assuming that the overall pixel height of print produced by any group of orifices is 0.062 inches. Although the lateral distance 46 between groups of orifices 14 may vary, a lateral distance of 0.040 inches has been found effective so as to permit a single linear array of transducers to be utilized without adversely affecting the performance of the apparatus.

In the foregoing preferred embodiment, a continuous field of print has been achieved utilizing a linear array of elongated transducers for all channels and providing a fanning out of the chambers adjacent the orifices to produce two linear arrays of grouped orifices. It will be appreciated that this fanning out, i.e., lateral displacement, may take on various forms which serve the purpose of simplifying fabrication of the apparatus while also providing high quality, large field printing using drop-on demand or impulse ink jet technology.

Further details concerning the nature of the drop-on demand or demand impulse ink jet devices depicted herein are disclosed in U.S. Pat. No. 4,646,106 and U.S. Pat. No. 4,714,934. Both patents describe elongated transducers which are capable of expanding and contracting along the axis of elongation and are therefore incorporated herein by reference. Further details concerning the spacing between orifices (i.e., slight variations in spacing to achieve compensation while maintaining substantially equal spacing) is disclosed in U.S. Pat. No. 5,258,774 which is incorporated herein by reference.

Although preferred embodiments of the invention have been shown and described, it will be appreciated that various modifications may be made which will fall within the true spirit and scope of the invention as set forth in the appended claims.

I claim:

1. An impulse ink jet apparatus for ejecting ink droplets in a direction of an axis of ejection comprising:

at least one linear array of elongated transducers having axes of elongation generally parallel with the axis of ejection of the ink droplets; and at least one printing arrangement comprising:

(a) a plurality of chambers having linearly aligned actuation locations respectively coupled to said transducers, each of said chambers having an ejection portion laterally displaced with respect to said actuation locations and to said ejection portions of an adjacent chamber, wherein said election portions of adjacent chambers overlap in a direction extending substantially parallel to said linear array of transducers; and (b) an orifice plate including groups of orifices respectively terminating said ejection portions of said chambers from which the ink droplets are ejected, wherein at least one of said groups of orifices comprises a plurality of orifices;

wherein said ink jet apparatus comprises one and only one said linear array of transducers for each of said printing arrangements.

2. The impulse ink jet apparatus of claim 1 wherein said orifices in each of said groups are linearly aligned.

3. The impulse ink jet apparatus of claim 2 wherein said orifices in each of said groups are linearly aligned in the direction extending substantially parallel to said linear array of transducers.

4. The impulse ink jet apparatus of claim 3 wherein orifices of non-adjacent groups are linearly aligned so as to form an array of at least two linearly aligned sets of said groups of said orifices.

5. The impulse ink jet apparatus of claim 4 wherein said orifices are equally spaced in the direction extending substantially parallel to said linear array of transducers.

6. The impulse ink jet apparatus of claim 1 wherein said ejection portions are elongated in the direction extending substantially parallel to said linear array of transducers.

7. The impulse ink jet according to claim 6 wherein all of said groups of orifices are linearly arrayed in a direction parallel to the elongation of said ejection portions.

8. The impulse ink jet apparatus of claim 1 wherein said ejection portions having a wall along the periphery, said wall and a nearest orifice to said wall being, at a minimum, a substantially vertical distance apart as two adjacent orifices in said respective group of orifices.

9. The impulse jet apparatus of claim 1 wherein, within at least one of said groups of orifices, adjacent orifices are spaced apart less than approximately 0.007 inches.

10. The impulse jet apparatus of claim 1 wherein, within at least one of said groups of orifices, adjacent orifices are spaced apart on the order of approximately 0.007 inches.

* * * * *

UNITED STATES PATENT AND TRADEMARK OFFICE

CERTIFICATE OF CORRECTION

PATENT NO. : 5,581,283
DATED : December 3, 1996
INVENTOR(S) : Robert L. Rogers

It is certified that error appears in the above-indentified patent and that said Letters Patent is hereby corrected as shown below:

Col. 4, line 23, change "election" to --ejection--.

Col. 4, line 57, change "vertical" to --identical--.

Signed and Sealed this

Eleventh Day of March, 1997

*Attest:*

Bruce Lehman

BRUCE LEHMAN

*Attesting Officer*

*Commissioner of Patents and Trademarks*